US005605335A

United States Patent [19]

Simpson

[11] Patent Number: 5,605,335

[45] Date of Patent: Feb. 25, 1997

[54] DART GAME APPARATUS

[76] Inventor: William R. Simpson, 52 Graham Lake Road, R.R.#4, Mallorytown, Ont., Canada, K0E 1R0

[21] Appl. No.: 585,565

[22] Filed: Jan. 16, 1996

[30] Foreign Application Priority Data

Jul. 4, 1995 [CA] Canada ..... 2153212

[51] Int. Cl.[6] ..... F41J 3/00

[52] U.S. Cl. ..... 273/406

[58] Field of Search ..... 273/348, 355, 273/369, 403, 406, 407, 408

[56] References Cited

U.S. PATENT DOCUMENTS

| | | | |
|---|---|---|---|
| 2,838,309 | 6/1958 | Merz et al. | 273/406 |
| 3,306,616 | 2/1967 | Baldwin et al. | 273/406 X |
| 3,614,102 | 10/1971 | Nikoden | 273/406 |
| 4,048,726 | 9/1977 | LeFebvre | 33/180 |
| 4,072,313 | 2/1978 | Murso et al. | 273/406 X |
| 4,088,322 | 5/1978 | Nikoden | 273/406 |
| 4,355,981 | 10/1982 | Kuperman et al. | 273/369 X |
| 4,890,847 | 1/1990 | Cartee et al. | 273/406 |
| 4,974,857 | 12/1990 | Beal et al. | 273/371 |
| 5,553,850 | 9/1996 | Savu et al. | 273/408 X |

FOREIGN PATENT DOCUMENTS

| | | |
|---|---|---|
| 883432 | 10/1971 | Canada . |
| 897738 | 4/1972 | Canada . |

*Primary Examiner*—William H. Grieb
*Attorney, Agent, or Firm*—Richard J. Hicks

[57] ABSTRACT

A dart game apparatus comprises a T-shaped track structure for a reciprocating, retrievable primary target. The transverse portion Of the T-shaped track has a moveable, secondary target which may be used by a visually challenged player in simulating that player's targeting of the primary board. The apparatus may include a definitive start or toe line to assist the challenged player in placing his or herself in proper orientation for play.

14 Claims, 10 Drawing Sheets

DART GAME APPARATUS

FIELD OF THE INVENTION

This invention relates to the game of darts and, in particular, to a dart game apparatus incorporating a retrievable target.

BACKGROUND OF THE INVENTION

In the conventional game of darts, a player throws the darts at the dart board target and then must walk to the board to count and record the score and to retrieve the darts before returning to the toe line. Having a player standing near a target board presents a potentially hazardous situation, particularly in an environment where several games are being played simultaneously, for example in a tournament or recreational environment. A player may be struck by an errantly thrown projectile while in the process of retrieving darts.

Moreover, player mobility that is required when the game is set up in the conventional manner does, to a great extent, prevent persons who are visually and or physically challenged from participating in the pleasant pastime of the game.

In other forms of recreation involving a target and projectiles thrown or shot against it, devices have been proposed for bringing a target back to a player/shooter to determine accuracy and score or to indicate a score electronically.

U.S. Pat. No. 4,974,857, Beall et al, of Dec. 14th, 1990 discloses an electronic dart game for use by visually challenged persons. An electronic processor is associated with the face of the dart target or board so as to detect a segment of the target hit by a projectile and to determine the value of the segment that has been hit. An audible announcing device responds to the processor for audibly announcing sufficient information to direct and score the game. This patent also discloses a roll-out mat to provide an integral start or throwing line to assist positioning of the player.

U.S. Pat. No. 4,048,726 Sep. 20, 1977, LeFebvre, discloses a sighting device for use by visually challenged people for sighting a projectile such as an arrow from a bow and arrow combination. Signal generators are incorporated to produce signals when the weapon is in the desired position.

U.S. Pat. No. 3,614,102 Nikoden, Sr., Oct. 19, 1971 and U.S. Pat. No. 4,088,322 May 9, 1978, Nikoden, Jr. disclose target control systems incorporating target carriers mounted for longitudinal movement along a track. In the latter patent, bullet deflection plates are suspended from the ceiling of a shooting range beneath the carrier rail to protect the upper carriage portion of the carrier.

Canadian Patent 883,432 Oct. 12, 1971 Gretzky discloses an apparatus for returning shot arrows from the target area back to the shooter.

Canadian Patent 897,738 Apr. 11, 1972 Dragone et al shows an arrow storage quiver.

SUMMARY OF THE INVENTION

The present invention provides structural and functional improvements over the prior art referred to and presents a dart game apparatus that incorporates a retrievable target so that, when used in a conventional sense, the game can be more safely played.

More significantly, the present invention provides a dart game apparatus incorporating features to enable a visually or physically challenged person to participate in a regulation dart game, both in a social, tournament or recreational setting and to indulge in the game in a solitary manner. To accomplish this, the dart game according to the present invention incorporates an arrangement whereby a player can throw darts at the target without moving from the toe line, subsequently bringing the target board back to the toe line where the player can count and record the points, remove the darts from the board and then return the board to its regulation position when it is then made ready for the next player.

The above mentioned arrangement comprises a retrievable target board which may be brought from its regulation position (8 feet from the toe line) back to the toe line and then returned to its regulation position. A secondary, simulated target is accessible to a player at the start/toe line and may be used by a visually challenged player, prior to throwing the projectiles, to assist that player in mentally "zeroing in" on the regulation target board.

If desired, a start/toe line mat may be utilized in combination with the movable target and simulated secondary target to assist the visually challenged player to maintain or to return to a previously utilized, optimum shooting position. The start/toe line mat incorporates pins for providing a physical contact for the player's feet.

By providing a retrievable target board, the potential danger of being struck by a projectile while in the process of retrieving ones darts is removed or substantially inhibited. Additionally, the moveable target also makes the game more accessible to children to seniors who may be challenged and inhibited by physical disabilities.

According to one broad aspect, the invention relates to a dart game apparatus for installation in a room, the apparatus comprising a target-supporting track for suspension above the floor of the room at a predetermined height, the track having a distal end and a proximal end.

A target hanger with a target detachably secured thereto is suspended from the supporting track for reciprocal movement thereon between the distal and proximal ends and means are associated with the track for effecting the reciprocal movement of the target hanger and the target along the track between the proximal end and the distal end.

Preferably, a second, transverse track is located normal to the target-supporting track adjacent the proximal end thereof and includes a simulated target suspended from the transverse track for movement therealong.

At least one motor means is utilized for effecting the reciprocal movement of the target hanger and includes a transmission mechanism that interconnects the motor means and the target hanger. In one example, the motor means consists of a single reversible motor and while the transmission means may comprise a chain, toothed belt or cable, a preferred example comprises a first drive pulley mounted on the motor and at least one idler pulley mounted at the end of the target-supporting track remote from the drive pulley. The flexible drive means in the form of a cable interconnects the drive and idler pulleys and the target supporting carriage is detachably secured to and depends from the flexible drive means, the target hanger comprising a reciprocal carriage.

According to another aspect, the invention relates to a dart game apparatus for installation in a game room, the apparatus comprising a target travel track for suspension above the floor of the room, the track having a distal end and a proximal end, a target-supporting carriage, with a target detachably secured thereto, suspended from the travel track for reciprocal movement thereon between the distal and proximal ends and a reversible drive motor associated with the travel track. Transmission means interconnects, the drive motor means and the target-support for effecting the reciprocal movement thereof along the travel track responsive to actuation of said drive motor means.

A second, transverse track is located normal to the target travel track adjacent the proximal end thereof and a simulated target suspended from the transverse track for movement therealong. A start/toe line mat is positioned on the floor of the room at a predetermined distance from the distal end of the target supporting track and includes pin means projecting upwardly therefrom to define the start line for a user of the dart game.

Switch means are located adjacent the distal and proximal ends of the target travel track for stopping the motor means and the carriage at predetermined locations in response to contact by the target-supporting carriage; and a control means is provided for actuation of said motor means.

BRIEF DESCRIPTION OF THE DRAWINGS

The invention is illustrated in the accompanying drawings in which.

DESCRIPTION OF THE PREFERRED EMBODIMENTS

Figure 1:
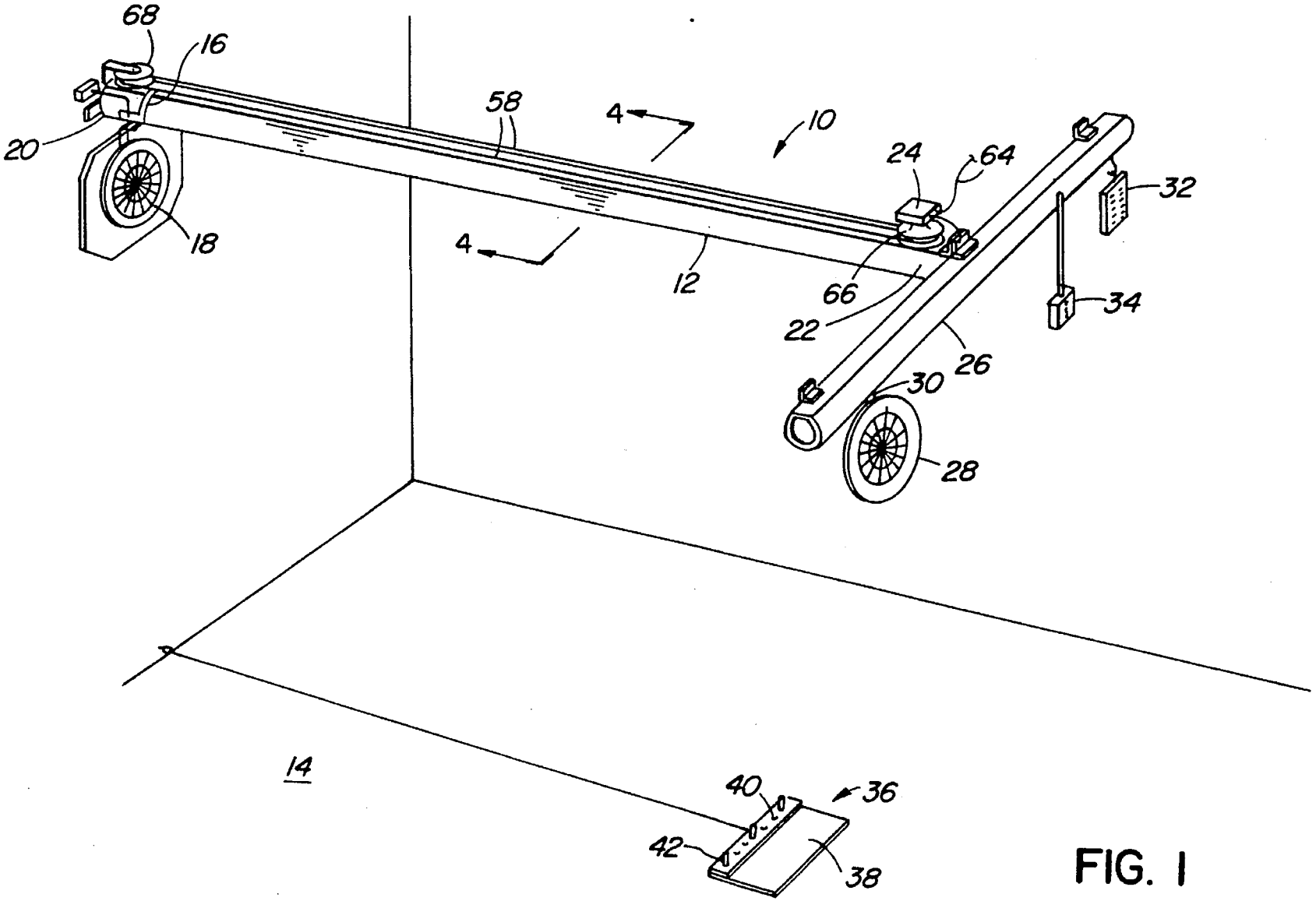
FIG. 1 is a perspective view of the apparatus according to the invention, located in a game room.

FIG. 1 is a perspective view of a dart game apparatus according to the invention, indicated generally at 10 and located, for example, in a game room. Certain elements of the combination thereof making up the present invention are useful for the enhanced enjoyment of the game of darts as the game might be played in a recreational or tournament environment. As such, the target-supporting track with the retrievable target board could, in itself, serve to enhance the safety aspect of the game as it is currently played. However, the description of the present invention is directed in the main to the combination of elements of the present invention that, when used, serve to expand the enjoyment of the game to visually and physically challenged persons who, heretofore, may not have been able to participate in the pastime. More specifically, the elements presented in this disclosure are directed primarily to the structural features that enhance the game for visually challenged participants.

Referring to FIG. 1, the dart game apparatus 10 includes a pair of tracks, the first being a target travel track 12 which is suspended above the floor 14 of the game room, hall or the like. Travel track 12 has a length that is generally commensurate with the regulation throwing distance between a player and the dart board target, approximately eight feet. A target-supporting carriage 16 (FIG. 4) has a regulation dart board or target 18 detachably secured thereto and is suspended from the carriage and the travel track for reciprocal movement between the distal end 20 and the proximal end 22 of the track. In FIG. 1, the target 18 is shown at the distal end 20 of track 12 and is at its "in play" position. After the player has thrown the projectiles at the target, the latter can be retrieved, travelling along track 12 to the proximal end 22 thereof where the player can remove the projectiles or darts from the target before sending the target back to the distal end of the track.

It will be appreciated that there are numerous ways in which to effect travel of the target between the distal and proximal ends of the track. One such method could be a simple push-pull arrangement using a retrieving cable or cord that might also utilize a counterweighted target to have it return to its "in play" position. However, for the purposes of efficiency and ease of use by a visually challenged participant, an electric, reversible drive motor 24 is mounted above the track 12 and, in combination with an associated drive line incorporating a drive pulley and an idler pulley and a suitable transmission drive such as a cable (FIG. 6), the target 18 may easily be retrieved from the distal end 20 and subsequently returned thereto.

As shown in FIG. 1, the apparatus 10 includes a second, transverse track 26 located at the proximal end 22 of track 12 and while this second track could consist of only one short arm to either side of the track 12, in the example shown it consists of an elongated track positioned normal to the target travel track 12. A second regulation size target or a simulated target 28 is suspended from a carrier 30 (FIG. 2) which, with the simulated target 28, may travel substantially the length of the transverse track 26. This track may also be utilized for carrying other elements of the assembly such as a score card 32 and a motor control means 34.

Figure 9:
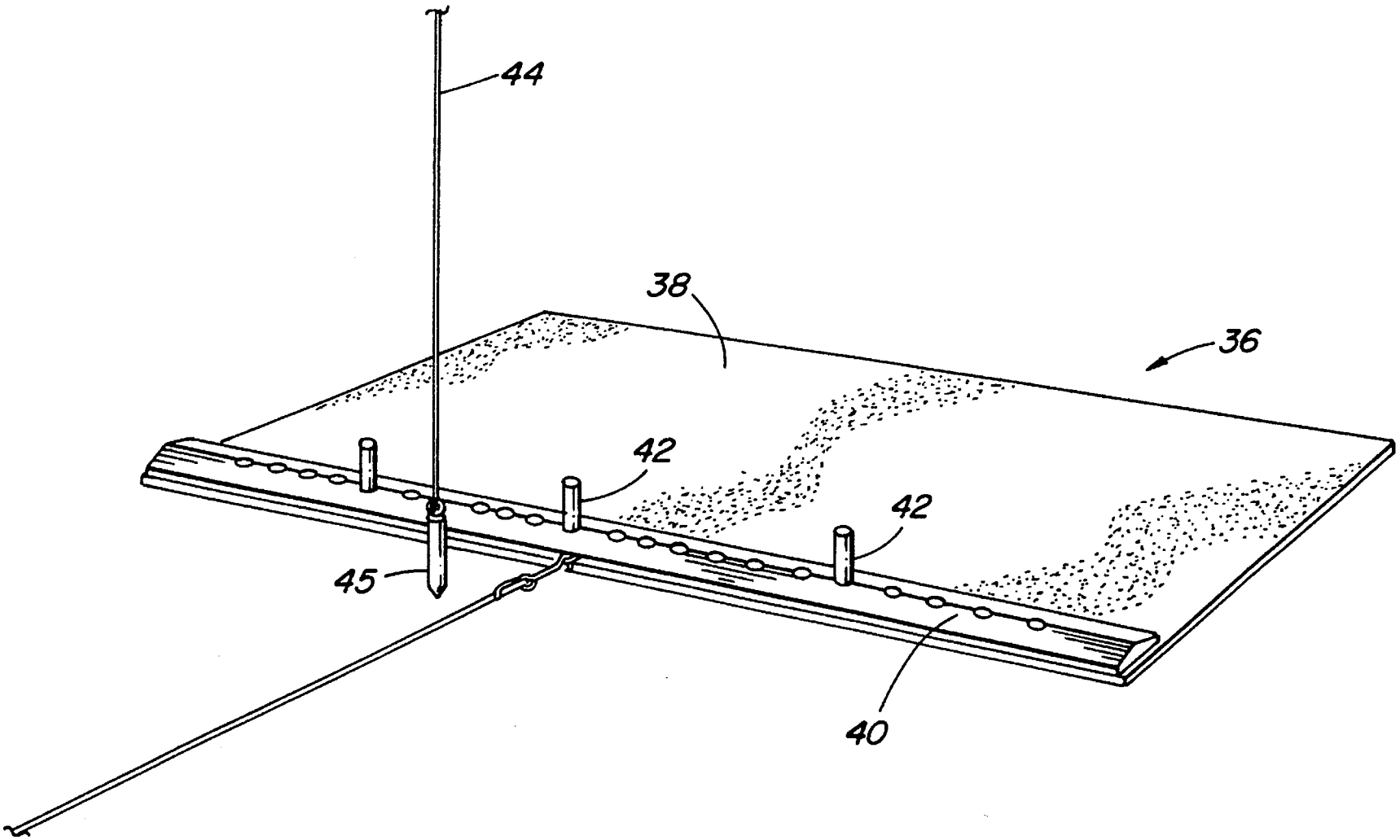
FIG. 9 is a perspective view of a start line indicator according to the invention.

While not considered an essential element to the function of the invention, a visually challenged player will find a start/toe line indicator 36 most helpful. The indicator 36, as shown in FIG. 9, is in the form of a flexible mat 38 having a straight peg board 40 along the terminal edge facing the target, the peg board being provided with moveable pins 42 which the player may use both to define the toe or start line and which can be moved to other apertures in the peg board to retain an optimum position for the player and to which the player may return to. For the sake of convenience, the indicator 36 can, by way of a line and fastener arrangement, be easily positioned by a visually challenged player at the correct distance from the distal end of the track 12 (and therefore the wall against which the target 18 is resting). Moreover, by utilizing a plumb line 44 suspended from the proximal end 22 of the track 12 or from an adjacent portion of track 26, the indicator 36 can be correctly positioned beneath the proximal end of track 12 which, in effect, generally defines the path of the dart or projectiles.

Figure 7:
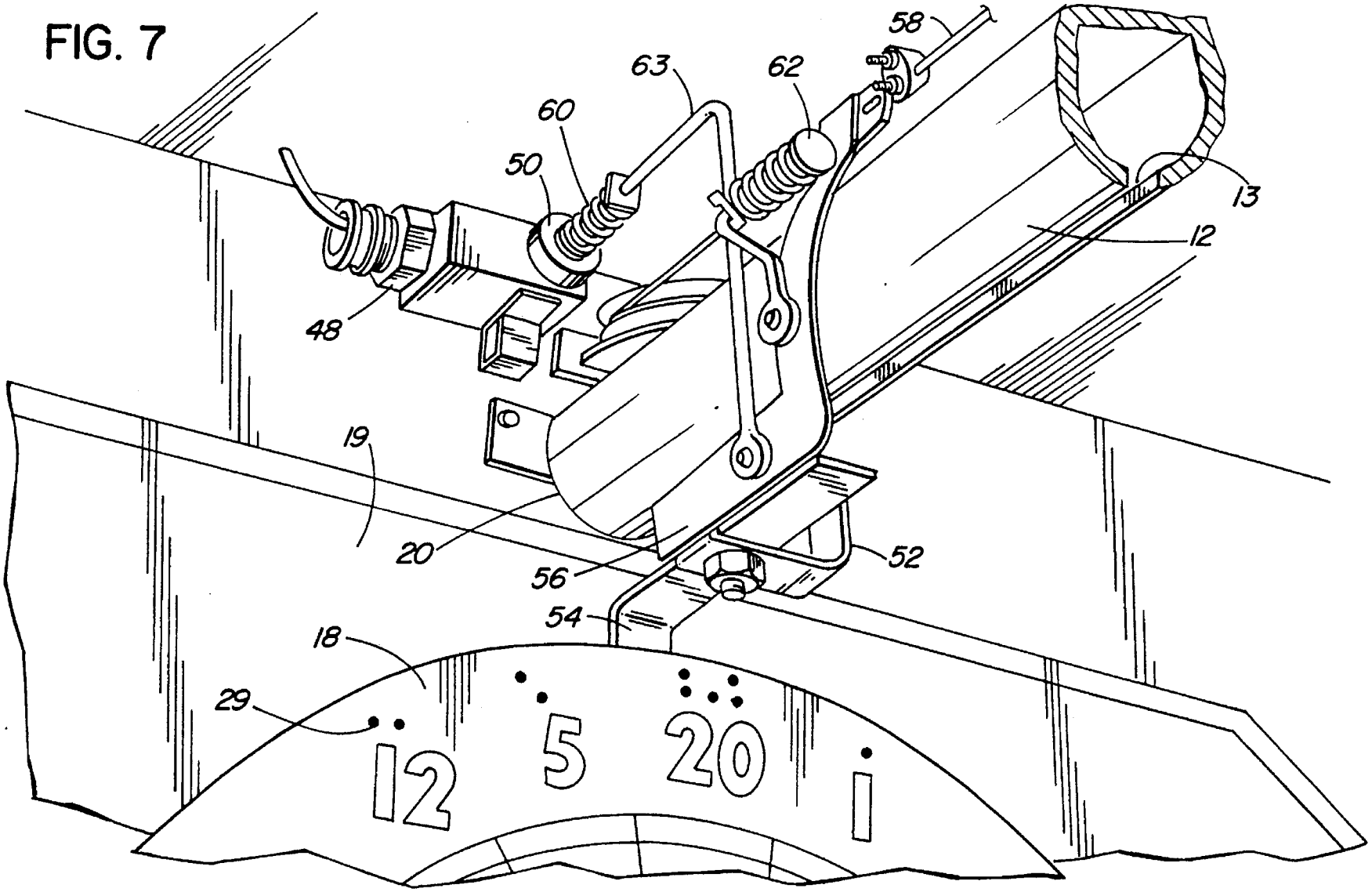
FIG. 7 illustrates the mechanism interconnecting the carriage and target suspension.
Figure 8:
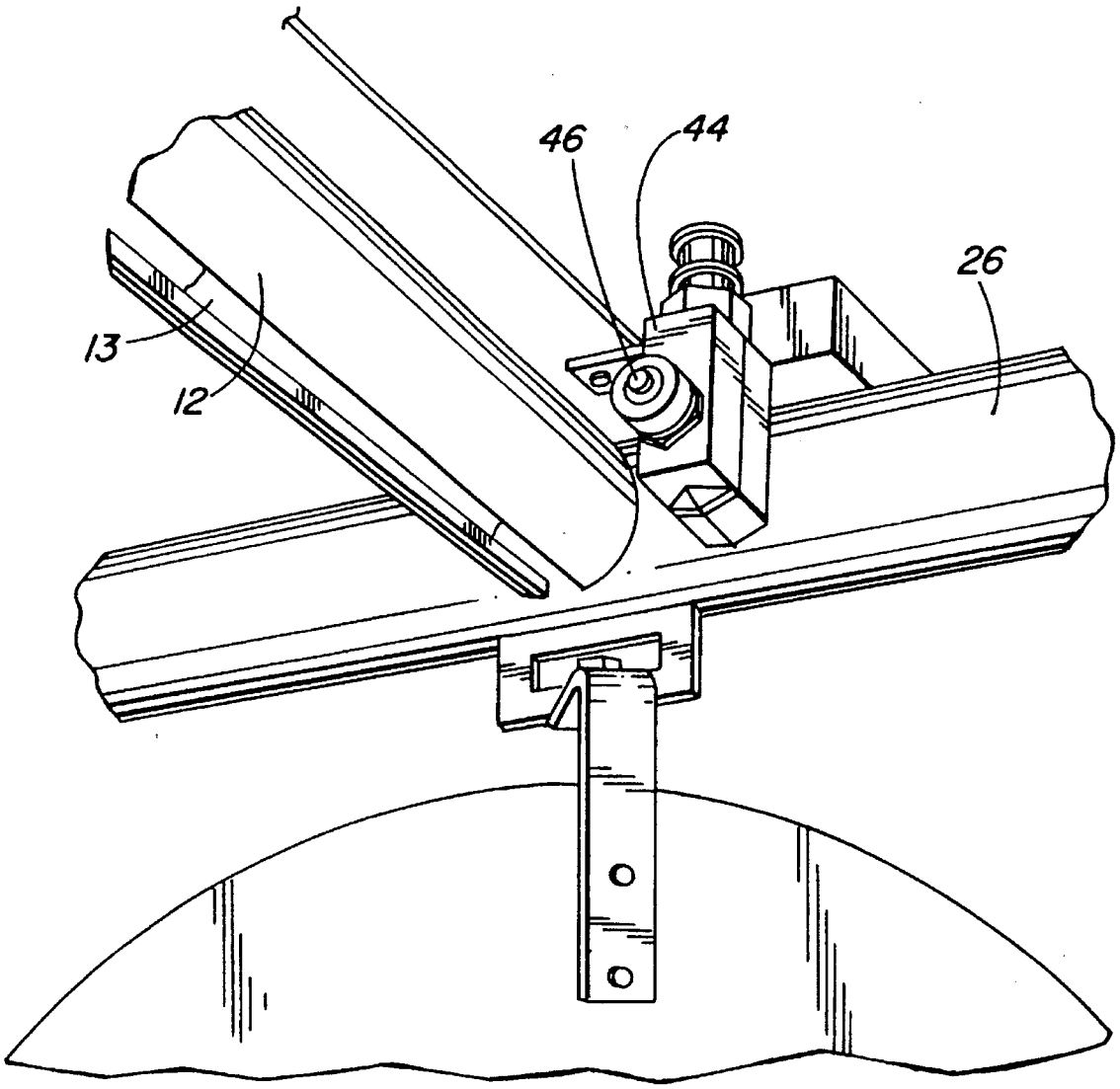
FIG. 8 illustrates a control switch adjacent the proximal end.

Switch means, as seen in FIGS. 7 and 8, are located adjacent the distal end 20 and proximal end 22 of the target travel track 12 and, when contacted, serve to stop the motor means 24 and the target-supporting carriage with its target at the predetermined locations, in this case at either end of the track.

FIG. 8 shows a limit switch 44 having a contact 46 and mounted adjacent the proximal end 22 of track 12 and in proximity of the transverse track 26.

FIG. 7 illustrates the distal end 20 of the track 12 and shows a further limit switch 48 secured adjacent the end of the track and having a contact 50. FIG. 7 also illustrates the lower bracket portion 52 of the target-supporting carriage, bracket assembly 52 including a first arm 54 which detachably carries a target 18 and its associated back board 19 and a second bracket 56 which serves to both connect the carriage to the transmission cable 58 and also to provide a pair of resiliently mounted switch actuators 60 and 62 on an L-shaped arm 63.

Figure 3:
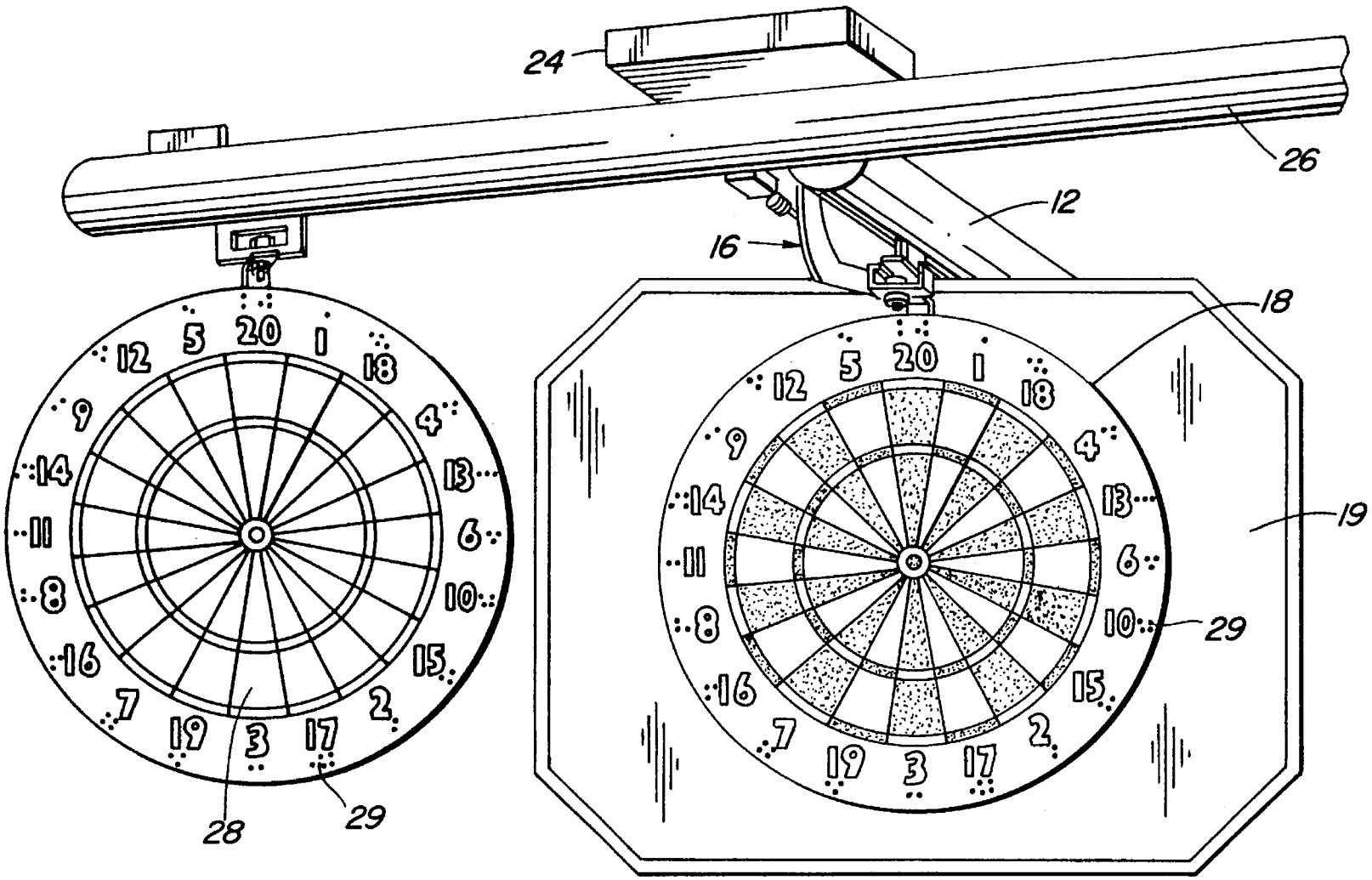
FIG. 3 is another perspective view as seen from a user's position but with the main target in a retrieved position adjacent the proximal end of the apparatus.

In FIG. 7, actuator 60 is shown in contact with the limit switch contact 50 (which stops the motor means when such contact is made) while the other resilient contact 62, directed toward the proximal end of the track 12, serves to engage contact 46 on limit switch 44 and thereby stop the motor when the carriage and its target reach the proximal end of the track as shown in FIG. 3. The player may utilize the motor control means 34 as shown in FIG. 1 to activate the motor means and send the target back to the distal end where resilient contact 60 engages limit switch 48 to again stop the motor and the travel of the carriage.

Figure 6:
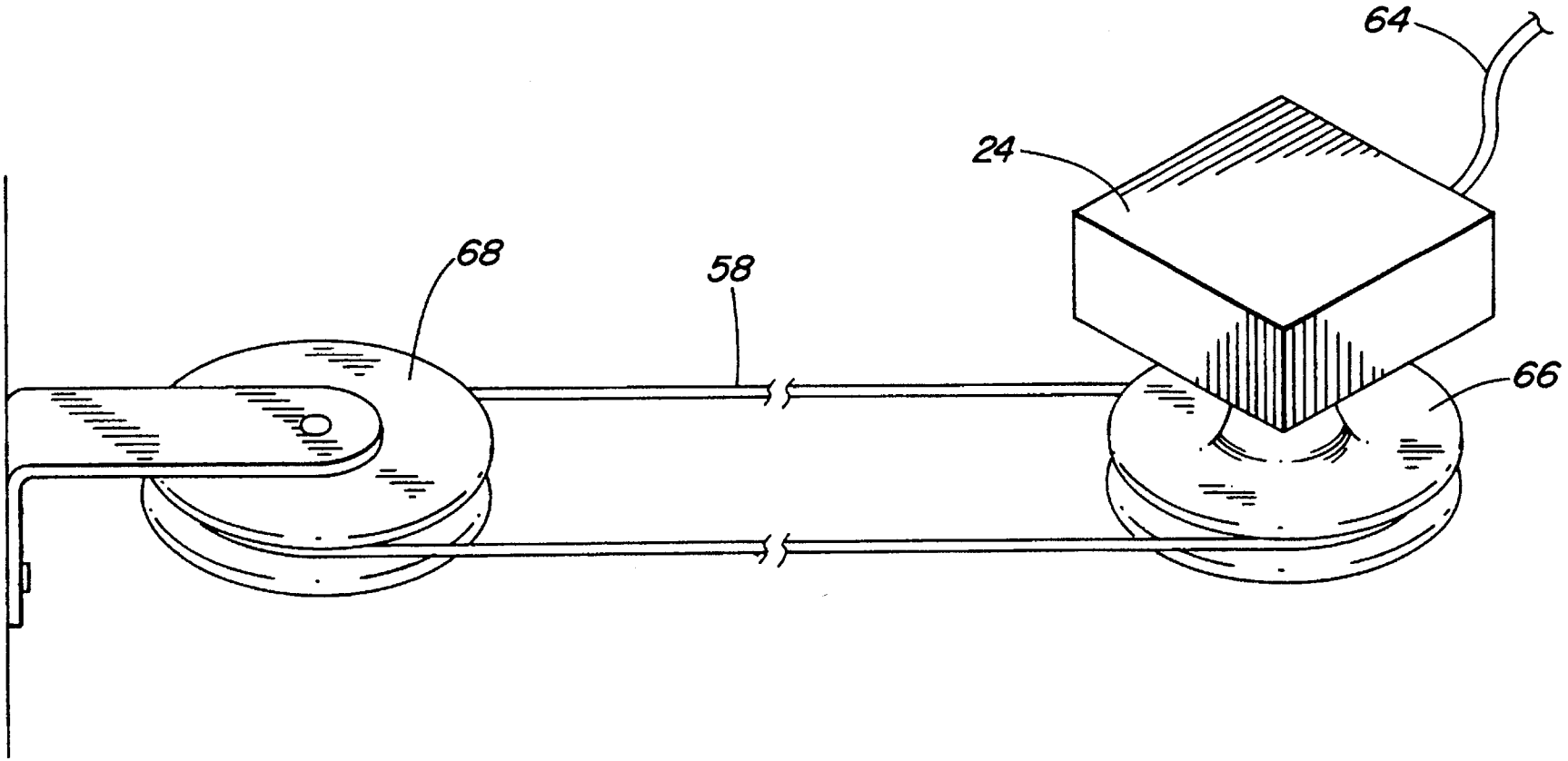
FIG. 6 is a perspective view of the motor and associated drive line.

FIG. 6 is a perspective view of the motor and associated drive line which provides the means for moving the carriage and its dependent target between the distal and proximal ends of the track 12. It will be appreciated that various motor drive arrangements could be utilized within the scope of the present invention to carry out this function and several forms of transmission are applicable such as sprockets and chains or toothed belts and sprockets. However, I have found that a single reversible electric motor located adjacent the proximal end of the track 12 with a single idler pulley located adjacent the distal end of the track 12 and interconnected by an aircraft cable, works extremely efficiently, is relatively inexpensive to manufacture and is quiet in operation.

As shown in FIGS. 1 and 6, the reversible motor 24 is located adjacent the proximal end 22 of track 12 and is interconnected to the motor control 34 through suitable wiring harness 64. Motor 24 is provided with a drive pulley 66 and the transmission means such as aircraft-grade cable 58 is trained around drive pulley 66 and idler pulley 68 located at the distal end of track Cable 58 is detachably and adjustably secured to carriage bracket 56 as shown in FIG. 7 so that, when the motor means 24 is actuated, cable 58 transmits movement of the carriage together with its attached target and switch contacts 62 and 60.

Figure 4:
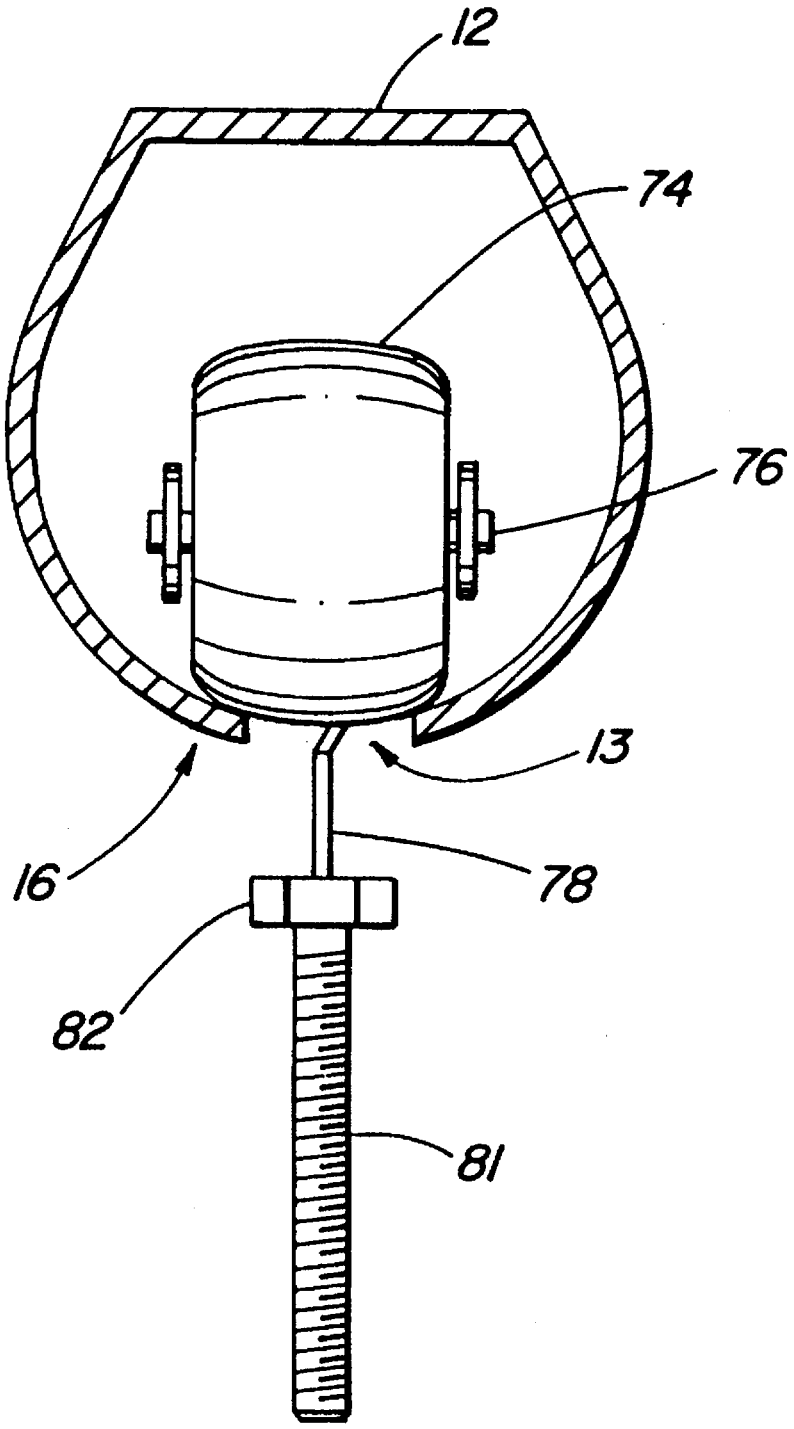
FIG. 4 is a cross-sectional view of the target travel track taken along the line 4—4 of FIG. 1.
Figure 5:
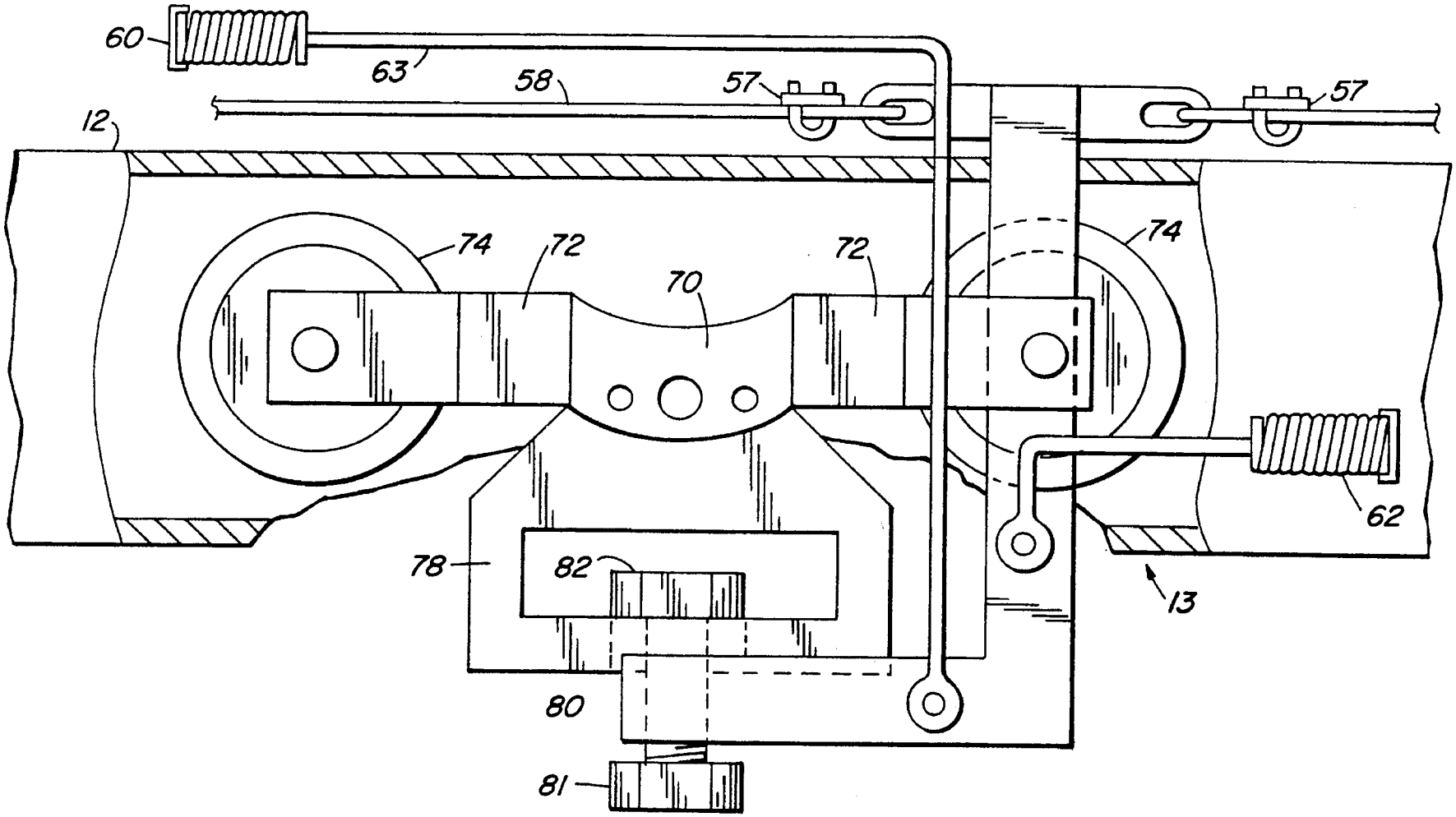
FIG. 5 is an elevation view of the carriage of FIG. 4.

FIGS. 4 and 5 illustrate the target-supporting carriage, a similar unit being provided in the transverse track 26 for carrying the simulated target 28.

Both carriages 16 and 30 include a base member 70 with less 72 that serve to space pairs of rollers 74 that are rotatably mounted to the less on journals 76. Hanger brackets 78 depend from the base 70 and include an aperture 80 to receive a bolt/nut combination 82 for detachably securing and suspending therefrom the target and bracket support means shown in FIG. 7 or simulated target shown in FIGS. 1 or 8.

Rollers 74 are maintained in proper orientation in the track 12 and in the track 26 by means of ribs or flanges 84 shown in FIG. 4.

It will be noted from FIGS. 3 and 7 that the target board 18 may be provided with a back up panel 19 having dimensions substantially beyond the perimeter of the target, its function being to receive projectiles that miss the target altogether and which otherwise might find their way into the walls of the room in which the apparatus is located. Panel 19 is not an essential element of the invention but I have found it to be a useful addition to the apparatus.

Figure 10:
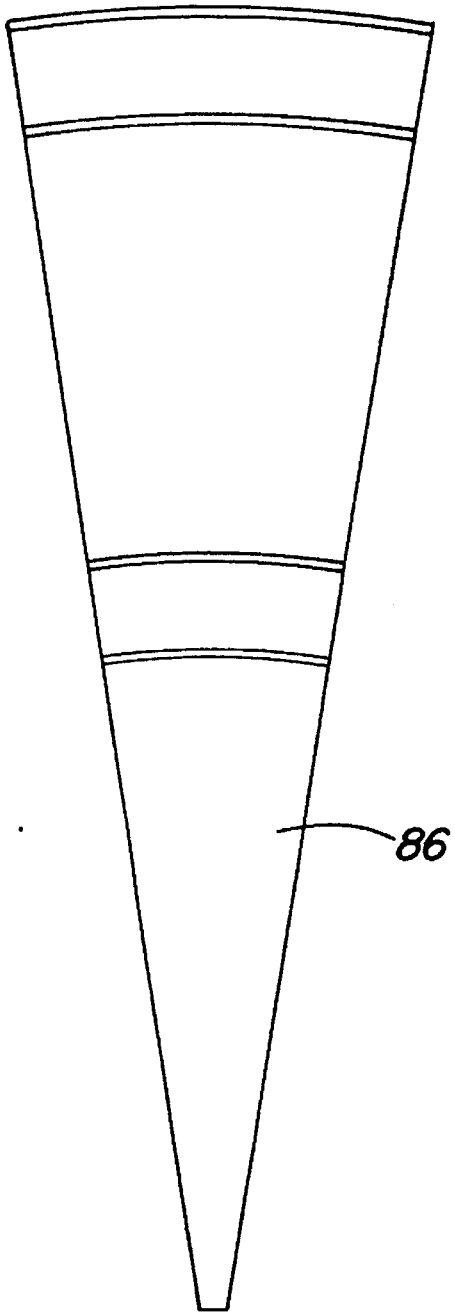
FIGS. 10 and 11 are elevation views of target segments.
Figure 11:
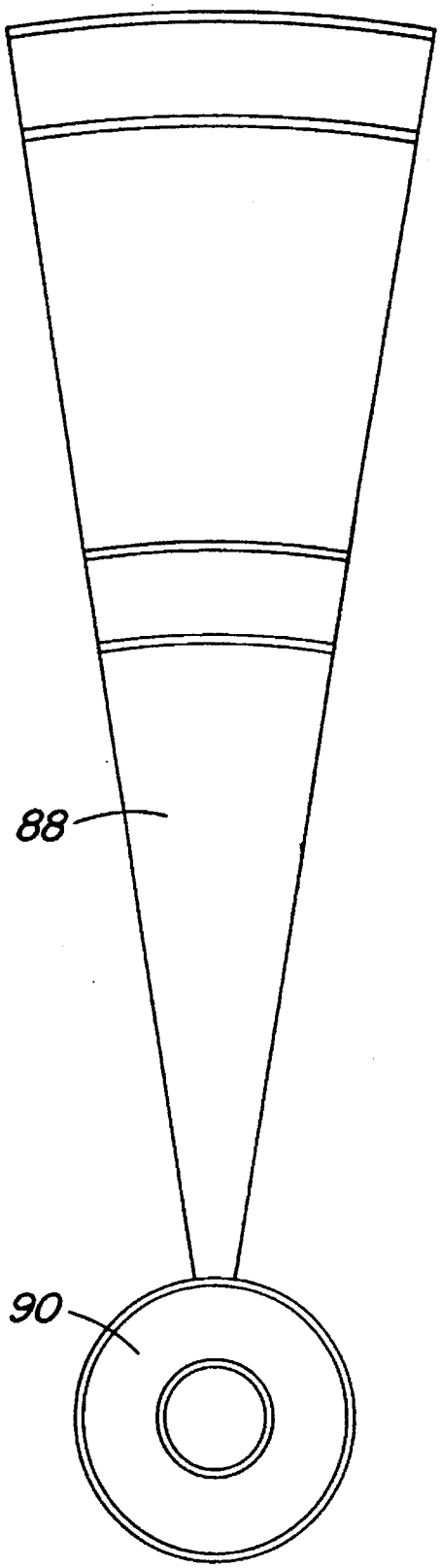

Also, I have found that the use of target segments as shown in FIGS. 10 and 11 are helpful in providing a visually challenged player with an indication of the size of portions of the target that the player will be addressing. Segments 88 and 86 are similar although segment 88 includes a bulls-eye portion 90.

METHOD OF USE

The following description of playing the game utilizing the present invention would apply to a visually challenged participant. While use of the start/toe line indicator is not an essential element of the invention and can, if necessary, be ignored, it can be helpful to a participant depending on the degree to which that player is visually challenged.

Figure 2:
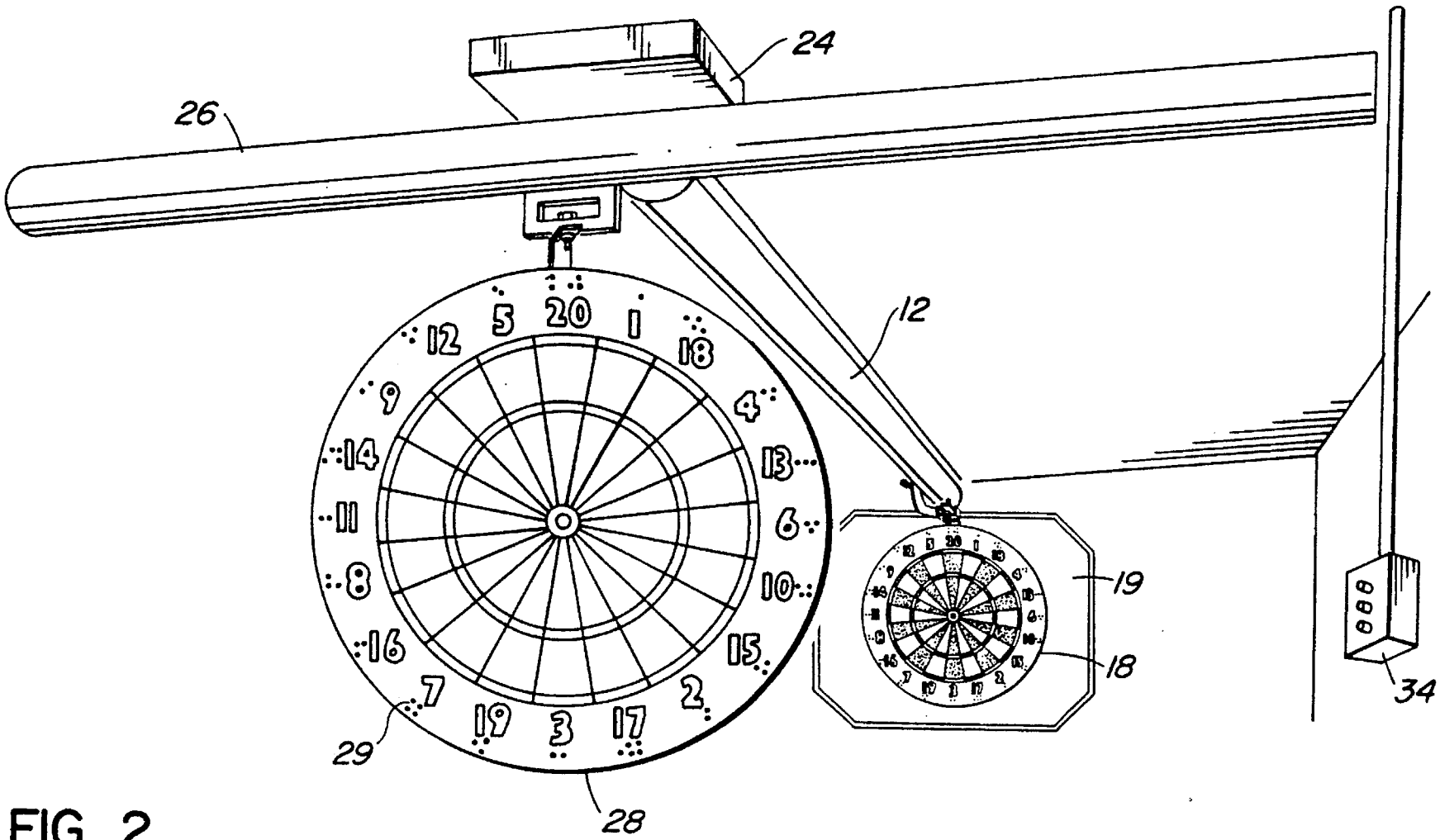
FIG. 2 is a further perspective view of the invention as seen from a user's position with the main target at the distal end of the apparatus.

Assuming that its use is desired, the mat 38 is located in its proper distance from the wall against which the target is located and is centered by the participant through a plumb bob 45 suspended from plumb line 44 detachably connected to track 26 adjacent its intersection with track 12 as shown in FIG. 9. This places the center of the mat 38 directly beneath and in line with track 12 and the centre of the target 18. Assuming for the moment that the participant is right handed, he or she would probably be addressing the target 18 as shown in FIG. 2 with the target 18 at the distal end 20 of track 12. If desired, the simulated target 28 could be drawn along track 26 to the position of FIG. 2 (or between that position and the left hand end of track 26) so that the player could benefit from a close-up look at the simulated target and could make the use of the numerals provided in braille adjacent the periphery of the target. When the player is ready to commence, the simulated target 28 in FIG. 2 is moved over to the left of the track 26 and the player, with his/her foot contacting the indicator pegs 42 on the mat 38 assumes what is considered to be the optimum position for throwing the darts. The player then proceeds to throw the darts and, after all the darts have been thrown, the motor control 34 is actuated and motor 24 operating the transmission cable causes the target-supporting carriage to bring the target to the proximal end 22 of track 12 to the position shown in FIG. 3. The player may then determine the score from the board and can mark it on the score card 32, remove the darts from the board and pass the game to the next participant. If that same player wishes to continue with another series of darts the pins 42 on the mat 38 will help to assume the earlier shooting position.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. A dart game apparatus for installation in a room, said apparatus comprising:

a target-supporting track for suspension above the floor of said room at a predetermined height, said track having a distal end and a proximal end;

a target hanger with a target detachably secured thereto and suspended from said supporting track for reciprocal movement thereon between said distal and proximal ends;

means associated with said track for effecting said reciprocal movement of said target hanger and said target along said track between said proximal end and said distal end; and a second, transverse track located normal to said target-supporting track adjacent the proximal end thereof with a simulated target suspended from said transverse track for movement therealong.

2. A dart game apparatus according to claim 1 wherein the means for effecting said reciprocal movement of said target hanger comprises at least one motor means and a transmission mechanism interconnecting the motor means and said target hanger.

3. A dart game apparatus according to claim 1 including a start/toe line indicator for positioning on the floor of said room at a predetermined distance from the distal end of said target supporting track and including means to define said start line for a user of said dart game.

4. A dart game apparatus according to claim 3 wherein said start/toe line indicator includes a flexible mat having a peg board along one edge thereof with removable pin means projecting upwardly therefrom.

5. A dart game apparatus according to claim 2 wherein said motor means comprises one reversible motor and wherein said transmission means comprises a first drive pulley on said motor and at least one idler pulley mounted at one end of said target-supporting track remote from said drive pulley, flexible drive means interconnecting said drive and idler pulley and said target supporting carriage being detachably secured to, and depending from, said flexible drive means; and wherein said target hanger comprises a reciprocal carriage.

6. A dart game apparatus according to claim 5 wherein said flexible drive means is a cable.

7. A dart game apparatus according to claim 5 wherein said flexible drive means is a chain.

8. A dart game apparatus according to claim 5 wherein said flexible drive means is a belt.

9. A dart game apparatus according to claim 5 including limit switches at both ends of said target-supporting track for stopping said motor means in response to contact by said target-supporting carriage.

10. A dart game apparatus for installation in a game room, said apparatus comprising:

a target travel track for suspension above the floor of said room, said track having a distal end and a proximal end;

a target-supporting carriage with a target detachably secured thereto and suspended from said travel track for reciprocal movement thereon between said distal and proximal ends;

drive motor means associated with said travel track;

transmission means interconnecting said drive motor means and said target-supporting carriage for effecting said reciprocal movement thereof along said travel track responsive to actuation of said drive motor means;

a second, transverse track located normal to said travel track adjacent the proximal end thereof and a simulated target suspended from said transverse track for movement therealong;

a start/toe line indicator for positioning on the floor of said room at a predetermined distance from the distal end of said target supporting track and including means to define said start/toe line for a user of said dart game;

means located adjacent said distal and proximal ends of said travel track for stopping said motor means and said carriage at predetermined locations in response to contact by said target supporting carriage; and control means for actuation of said motor means.

11. A dart game apparatus according to claim 10 wherein said drive motor means is a reversible drive electric motor.

12. A dart game apparatus according to claim 10 wherein said start line indicator comprises a mat having aligned, upwardly projecting pins to define said start/toe line for said game user.

13. A dart game apparatus for installation in a game room, said apparatus comprising:

a target travel track for suspension above the floor of said room, said track having a distal end and a proximal end;

a target-supporting carriage, with a target detachably secured thereto, suspended from said travel track for reciprocal movement thereon between said distal and proximal ends;

a reversible drive motor associated with said travel track;

transmission means interconnecting said drive motor means and said target-support for effecting said reciprocal movement thereof along said travel track responsive to actuation of said drive motor means;

a second, transverse track located normal to said target travel track adjacent the proximal end thereof and a simulated target suspended from said transverse track for movement therealong;

a start/toe line mat for positioning on the floor of said room at a predetermined distance from the distal end of said target supporting track and including pin means projecting upwardly therefrom to define said start line for a user of said dart game;

switch means located adjacent said distal and proximal ends of said target travel track for stopping said motor means and said carriage at predetermined locations in response to contact by said target-supporting carriage; and control means for actuation of said motor means.

14. A dart game apparatus according to claim 13 wherein said transmission means comprises a drive pulley on said motor, an idler pulley adjacent one end of said travel track remote from said motor and a flexible drive member interconnecting said pulleys.

* * * * *